United States Patent [19]

Nakagaki et al.

[11] Patent Number: 4,527,404

[45] Date of Patent: Jul. 9, 1985

[54] WARP-KNITTED LACE STRIP

[76] Inventors: Noboru Nakagaki, 701, Kurimorichohama, Fukui City, Fukui, Prefecture; Yoyu Fujikawa, 402, Enzan 1-Chome, Fukui City, Fukui, Prefecture, both of Japan

[21] Appl. No.: 578,619

[22] Filed: Feb. 14, 1984

Related U.S. Application Data

[60] Continuation of Ser. No. 337,166, Jan. 5, 1982, , which is a division of Ser. No. 81,067, Oct. 29, 1979, Pat. No. 4,307,496.

[30] Foreign Application Priority Data

| | | | |
|---|---|---|---|
| Feb. 19, 1979 | [JP] | Japan | 54-18600 |
| Feb. 19, 1979 | [JP] | Japan | 54-18601 |
| Mar. 15, 1979 | [JP] | Japan | 54-30769 |
| Mar. 15, 1979 | [JP] | Japan | 54-30770 |
| Mar. 22, 1979 | [JP] | Japan | 54-34018 |

[51] Int. Cl.[3] ..... D04B 7/16

[52] U.S. Cl. ..... 66/202; 28/168

[58] Field of Search ..... 66/202, 190, 191, 192, 66/193, 194, 195; 28/168

[56] References Cited

U.S. PATENT DOCUMENTS

| | | | |
|---|---|---|---|
| 2,365,315 | 12/1944 | Williams | 28/168 X |
| 3,757,541 | 9/1973 | Frohlich et al. | 66/202 |
| 4,096,610 | 6/1978 | Bassist | 66/202 X |

FOREIGN PATENT DOCUMENTS

| | | | |
|---|---|---|---|
| 2079718 | 7/1971 | France | 66/192 |
| 2297277 | 8/1976 | France | 28/168 |
| 48-4231 | 2/1973 | Japan | 66/198 |

*Primary Examiner*—Ronald Feldbaum
*Attorney, Agent, or Firm*—Eric P. Schellin

[57] ABSTRACT

An entirely warp-knit lace strip having sinuate scallops knit of bent scallop-forming yarn, the scallops having outwardly protruding U-shaped picots at their edges.

The lace strip described is made by a series of steps including the formation of chain stitch lines in step-like indentation by overlapping the scallop-forming yarns which are shifted through a plurality of needles after scallops have been formed for all stitch lines. Simultaneously, picot-forming yarns are transversely shifted so as to protrude from the edges of the scallops. The protruding parts are held or attached to soluble yarn portions. As desired, the soluble yarns are dissolved to free the scallops and picots.

Several portions of lace texture are made from two kinds of yarn, an insoluble one and a soluble one with respect to the same solvent, which are threaded on the same guide bar used to form the mesh fabric. The guide bar serves to knit the insoluble fabric portions and the soluble portions in an alternating arrangement along the direction of the needle bar. Simultaneously scallops are formed on the edge of the ground fabric by means of another guide bar and protruding picots are formed on these scallops which are attached to soluble fabric portions so as to form the entire fabric integrally. When adjacent insoluble fabric portions are connected by insoluble yarn, the insoluble fabric portions, i.e., lace strips described, are not separated after dissolution of the soluble fabric portion. This makes finishing processes, such as drying, easier.

9 Claims, 15 Drawing Figures

F.I G.2

F.I G. 5
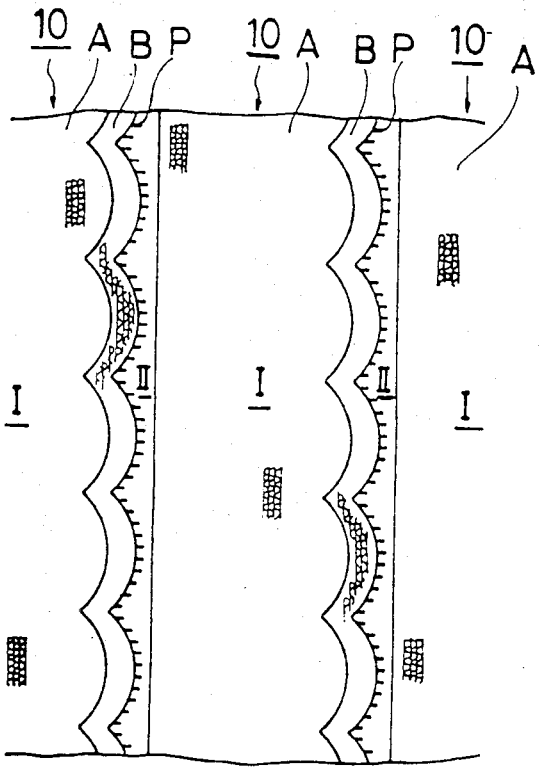
F I G. 9
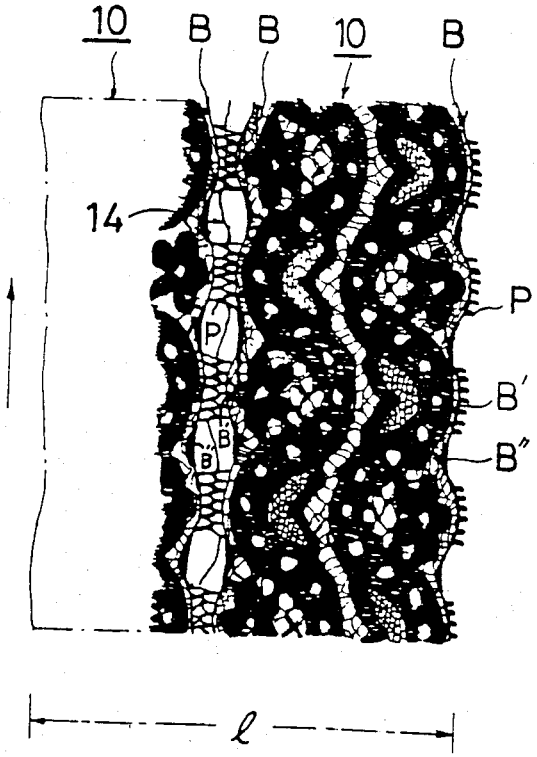

WARP-KNITTED LACE STRIP

This application is a continuation of application Ser. No. 337,166 filed Jan. 5, 1982, which is a continuation-in-part of U.S. application Ser. No. 81,067, filed Oct. 2, 1979, now U.S. Pat. No. 4,307,496.

BACKGROUND OF THE INVENTION

Warp-knit lace strips are conventionally used as border ornament on women's underwear and outerwear. In general, the lace strip is provided with sinuate parts called scallops consisting of repetitive recesses and having protrusions on their edges called picots. The picots are formed of U-bent yarns and protrude from the scallops. Lace fabrics of this type have been knit in a single direction, generally by a Raschel knitting machine and a plurality of units of lace strips have been knit into one piece of fabric extending over the full width of the needle row and have been separated into units in a conventional manner.

In the prior method of separation of the plurality of lace strips into unit strips required cutting a mesh fabric interface between the adjacent lace strips along the sinuate lines of the scallops. This method also required the use of a draw thread yarn to connect picots of adjacent lace strips. The draw thread is pre-knit into the fabric and removed after completion of the knitting to obtain separate units of lace strip.

The described prior method suffers from several disadvantages, i.e., in the separation step. For example, if a manual cutting operation is employed efficiency is low because of the care which must be taken in order to avoid cutting the knitted lace strip. Accurate cutting along a sinuate line is difficult in practical work and yarn ends remain at the cut-end of the mesh fabric. This prevents fine finish of the outer edge of the scallops and clear protrusions of the picots.

Where mechanical cutting is employed, the remaining yarn ends at the outer edge of the scallops are ragged which prevents a fine finish despite any advantages obtained in increased production. Accordingly, it can be seen that lace strips obtained by these methods have been extremely low in commercial value as border ornaments.

When a draw thread is employed, separation in units by release of the draw thread is better than the use of cutters, however, other disadvantages are present in the inferior ornamental properties since the draw thread is knitted in from the sinuate scallops to the protruding scallops. Since alignment of protruding ends of the picots of the adjacent lace strip is required, this causes sinuation of the scallops on one lace strip to be weaker and nearly straight at the protrusion of the scallops of the adjacent lace strip, and picots cannot be provided on the adjacent lace strip.

Illustrative of the known prior patent art on separating strips of fabric from a knitted fabric by dissolving soluble thread are U.S. Pat. Nos. 289,094 and 307,801. These patents disclose the use of soluble threads to separate strips of fabrics where the soluble threads are woven or knitted into the ground fabric.

SUMMARY OF THE INVENTION

The present invention relates to an improved warp-knit lace strip and method of manufacture, and, in particular, to an improved warp-knit lace fabric knitted with a plurality of lace strips held to one another by soluble yarn warps for separating the plurality of lace strips into units and a method of manufacturing the same.

An object of this invention is to provide an entirely warp-knit lace strip by knitting sinuate scallops from scallop-forming yarn on the edge of a ground fabric with the scallops having a large number of U-shaped picots protruding from their edges, the protruding portion of picots being knit into soluble fabric portion and being formed in series with and adjacent to the scallop portion.

Another object of this invention is to provide a method of manufacturing warp-knit lace strips, in which sinuate scallops having picots are formed on the edge of an insoluble fabric portion which is adjacent to a soluble fabric portion, followed by dissolving the soluble fabric portion with water or the like and removing the insoluble fabric portion.

A further object of this invention is to provide a material for manufacturing warp-knit lace, in which an insoluble fabric portion and a soluble one are alternately arranged along the direction of the needle-row of the warp-knitting machine.

Still another object of this invention is to provide a method of obtaining knit lace strips having scallops and picots in which insoluble fabric portions and soluble ones are knit in an alternating arrangement followed by dissolution of the soluble portions and the insoluble fabric portion is separated into individual units.

Another object of this invention is to provide a fabric for manufacture of warp-knit lace strips in which insoluble draw threads are knitted-in between adjacent insoluble fabric portions to connect the two while knitting the insoluble and soluble portions in alternating arrangement in the direction of the needle-row of the warp-knitting machine.

It is another object of this invention to provide a method of manufacturing knit lace strips wherein insoluble fabric portions and soluble ones are knit into one piece in an alternating arrangement in the direction of the needle-row of the warp-knitting machine, adjacent insoluble fabric portions are made to be inseparable from each other by knitting insoluble removable draw threads between these insoluble fabric portions.

BRIEF DESCRIPTION OF THE DRAWINGS

The foregoing objects and others will be more apparent from the following description of the drawings and from the specification.

FIG. 5 is a schematic view of the fabric comprising insoluble portions in an alternating arrangement;

FIG. 9 shows a prior art lace fabric separated into units of lace strips by removal of the draw thread;

DETAILED DESCRIPTION OF THE INVENTION

Figure 8A:
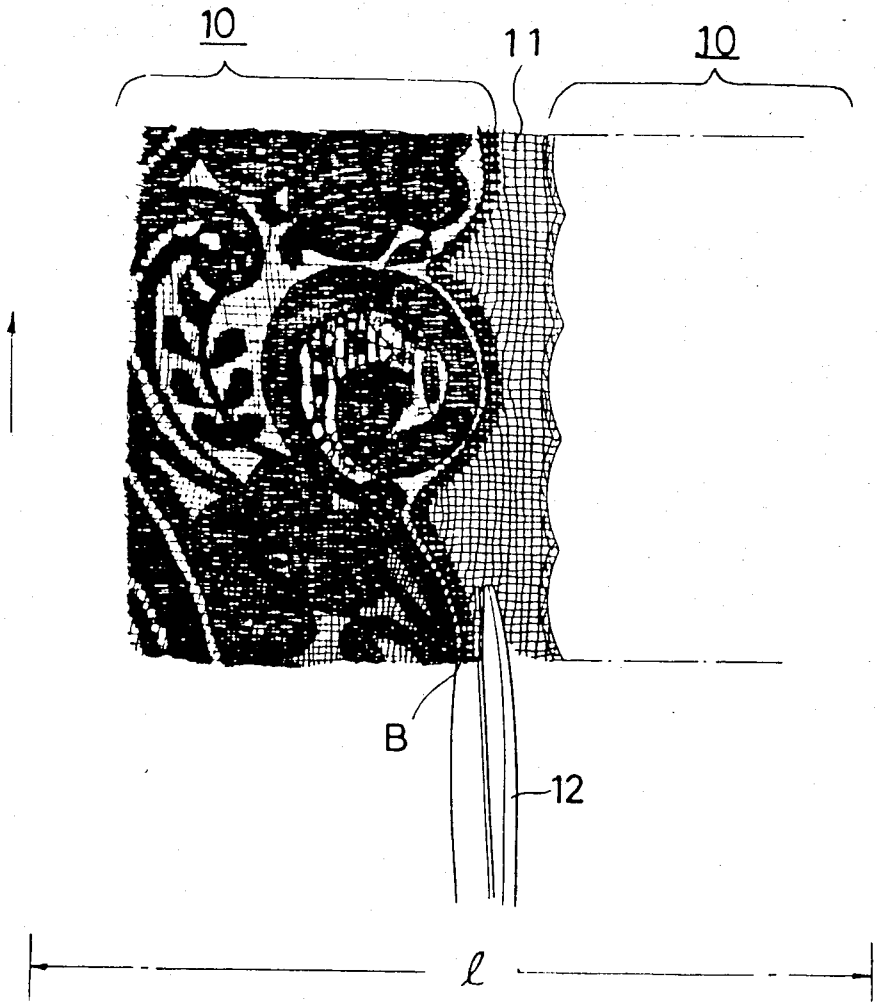
FIG. 8A shows schematically the condition of a piece of fabric consisting of a plurality of knit units after cutting into strips of the lace shown in FIG. 8.
Figure 8:
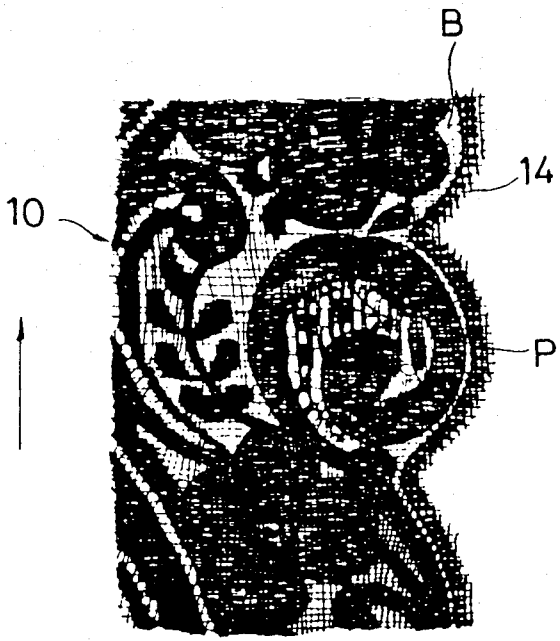
FIG. 8 shows a prior art lace strip separated from the original fabric by cutting along the scallops.

In FIGS. 8 and 9 conventional lace strips 10 are shown having sinuate parts called scallops B consisting of repetitive recesses and having protrusions on their edges called picots P. The picots are U-shaped yarns protruding from the scallops B. The lace fabric of this type is knit into one piece of fabric having a plurality of units of lace strips extending the full width of the fabric having a web section 11 between each unit.

FIG. 8A shows the separation of the fabric piece into unit strips by cutting web 11, which is a mesh fabric interface between two adjacent lace strips 10, along the sinuate line of the scallops B by a cutter 12 which is operated manually or mechanically. A draw thread 14 is used to connect the picots P of adjacent lace strips 10, as shown in FIG. 9.

Figure 1:
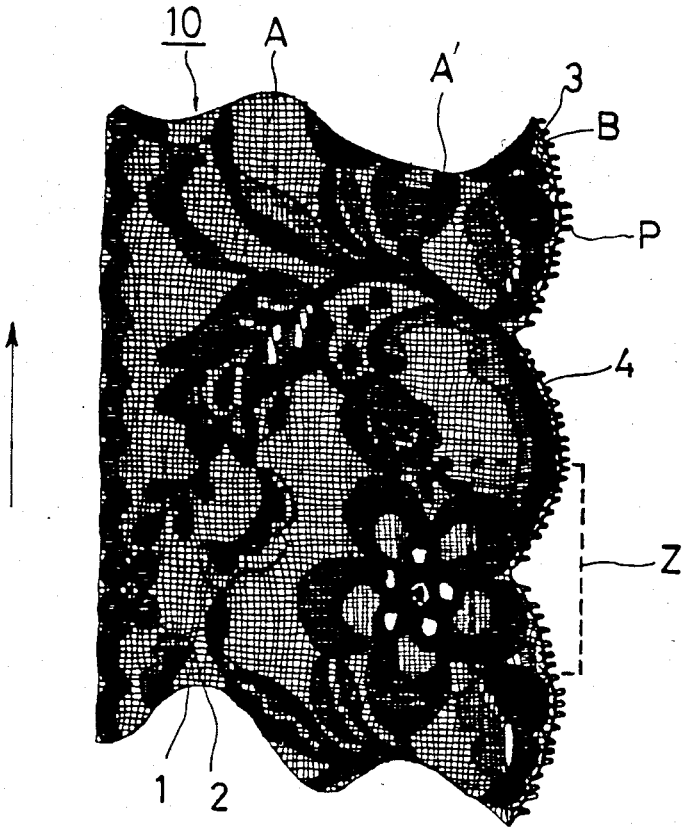
FIG. 1 is a plan view of a warp-knit lace strip of the invention.

Referring to FIG. 1 shown is a unit of warp-knit lace strip 10 in accordance with this invention. Lace strip 10 is knit along the direction of the arrow shown, in practice, is continuous in both upward and downward directions as shown in FIG. 1.

Lace fabric 10 consists of a multitude of lines of stitches, formed of a number of warps 1 and 2 for connecting the lines of stitches with each other, thereby turning mesh fabric A into marquisette on which the patterning yarns are knitted-in using Jacquard equipment for forming the pattern A'. In lace fabric 10, scallops B in sinuate form are formed from yarns 3 on the right hand portion. Thick hemming yarns 4 are knit into the scallops B. Picots P are provided in large number on the edge of the scallops B by knitting suitable yarns into the scallops B in U-shaped protrusions from the scallops.

A description will now be given of a number of embodiments of the products and methods of this invention. In describing FIGS. 2 through 7B, elements corresponding to those of FIG. 1 will be denoted by the reference character where possible.

Figure 2:
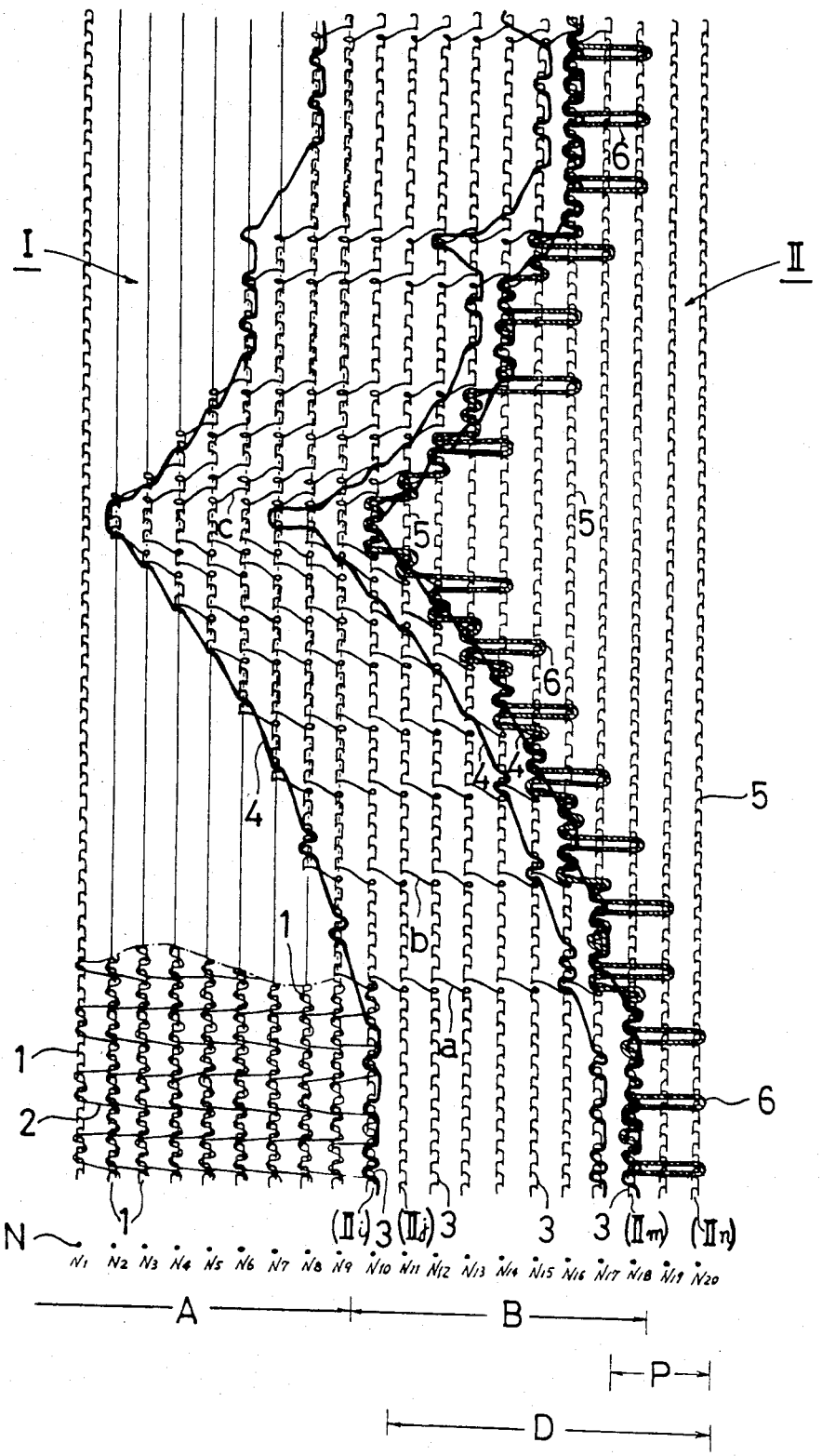
FIG. 2 is a view of the knit structure of the part shown in FIG. 1, enclosed by dotted line Z.

FIG. 2 is a view corresponding to the area within the dotted line Z of FIG. 1. A ground or foundation fabric A, the scallops B and picots P are formed by the following described knitting steps, which details the positions of needles N. The ground fabric A is knit of warps 1 and 2 by means of needles $N_1$ to $N_9$. Each needle forms chain stitches in every course of warp 1 and another warp 2 is interlaced between the chain stitches adjacent to each other in a transverse direction to form the ground fabric A. Describing this structure in greater detail with respect to needles $N_1$ and $N_2$, the warp 2 is inserted through three consecutive courses on the stitch-line formed by the needle $N_1$, transferred to the adjacent needle $N_2$, inserted into three consecutive courses on the stitch-line formed by needle $N_2$ as above, and then returned to the initial needle $N_1$. Repetition of these steps with respect to needles $N_1$ to $N_9$ forms a marquisette structure, i.e., ground fabric A. The knitting process herein described is not limited to marquisette. As is apparent from the description of FIG. 1, a pattern may be knit into the ground fabric A.

A total of nine ends of scallop yarn 3 are shifted to correspond with the sinuation of scallops B while stitch forming, using the nine corresponding needles $N_{10}$–$N_{18}$. More specifically, the nine scallop yarn ends 3 are threaded on needles $N_{10}$–$N_{18}$, at the first course (the lowest position on the drawings), and overlapped at this needle position to form chain stitches in a line corresponding to the number of courses. The scallop yarns 3 are then shifted to the left side at the course a at a rate of one needle pitch, i.e., to another nine needles $N_9$–$N_{17}$ for the next overlap to form chain stitches in line corresponding to the required number of courses, at the position to which they shifted. The scallop yarns are shifted to the left side at course b at the same rate as the previous one needle-pitch onto needles $N_8$–$N_{16}$. When these scallop yarns reach the course c after repetition of the above described procedure they are shifted to the right side at the rate of one needle-pitch and the overlapping positions are shifted to the right side step by step. These repetitive steps result in sinuate scallops.

Yarns 4 are hemming yarns used to knit the scallops. Two ends are arranged on the outer edge, i.e., the right side in FIG. 1, and one strand is positioned on the inner edge, i.e., left side, in FIG. 1 and are inserted into chain stitches in line of the scallops-forming yarns 3 for the formation of a knit structure while curving correspondingly to the sinuation of scallops 13.

Warp yarns 1 and 2, comprising ground fabric A, yarn 3 for scallops B, hemming yarns 4 and picot forming yarns 6, hereinafter described, are all water-insoluble and comprise all of the insoluble fabric portion I.

In FIG. 2, soluble warp yarns 5 are knitted-in courses D of the lace fabric. The warp yarns 5 are drawn through a guide bar commonly used for warp 1. In the embodiment shown in the drawing, ends of soluble yarn 5 are threaded through 10 needles, $N_{11}$–$N_{20}$, which are positioned over a width D ranging from the wale (IIj) lying at a pitch of one gauge outside the wale (IIi) that corresponds to the portion of scallops B to the wale (IIn) lying at a pitch of two gauges outside the wale (IIm) that corresponds to the end of scallops B protrusion. Warps 5 compose the soluble fabric portion II and is made by forming chain stitches in all the wales in the same number as the number of courses. The scallop-forming yarns 3 are overlapped on soluble warps 5 in some of the knitting area. The line of chain stitches formed of warp 5 in this overlapping area is not illustrated. As examples, soluble yarn 5 and insoluble yarn 1 may be of vinylon and nylon, respectively.

Yarns 6 are used to form the picots P. The yarns 6 are knit into the scallops B by inserting into a line of chain stitches formed of soluble yarns 5. Yarns 6 extend approximately two gauges from the scallop edges to the required course and return to the scallop for repeated insertion into the scallop B to produce a multitude of U-shaped protrusions. In this manner protruding picots P are fixed in the soluble fabric portion II.

Figure 3:
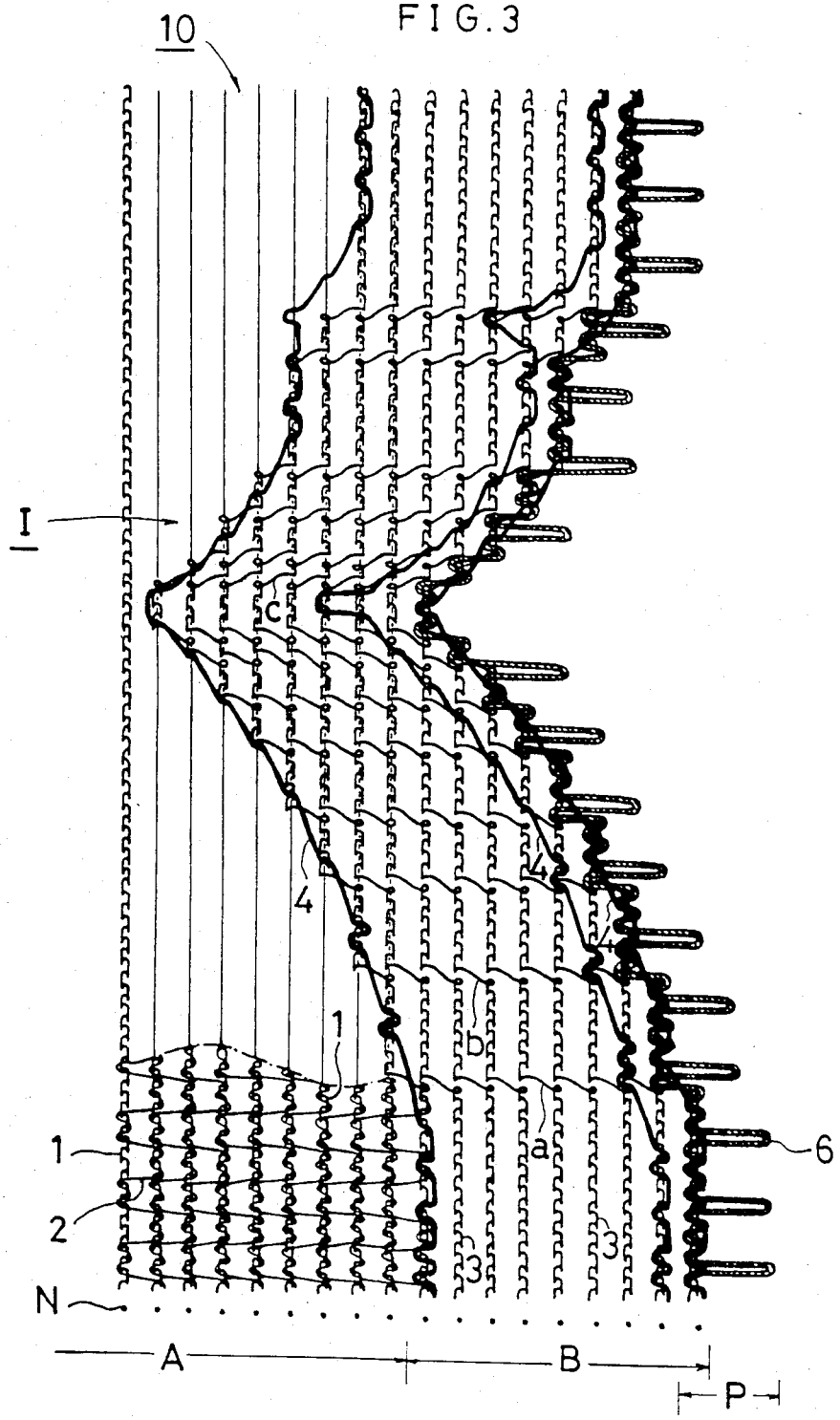
FIG. 3 is a view of the knit structure of the part shown in FIG. 2 after removal of the soluble portion by dissolving.

When the fabric thus obtained is immersed in water, the soluble fabric portion II is dissolved and the edge of insoluble fabric portion I appears as sinuate scallops 13 provided with picots P as shown in FIG. 3.

The formation of sinuate scallops B from insoluble yarns on the edge of insoluble fabric portion I, and the formation of picots P of similar insoluble yarn in the shape of protrusions from the scallops, and the removal of the soluble fabric portion by dissolution after knitting-in of the picots P into soluble fabric portions ensures not only clear appearance of picots P but also stronger sinuation of scallops B, and in addition, enables easy setting of the lengths of the picot protrusions. Accordingly, it is apparent that tasteful lace strips furnished with scallops and picots of diverse shape can easily be manufactured.

Figure 4:
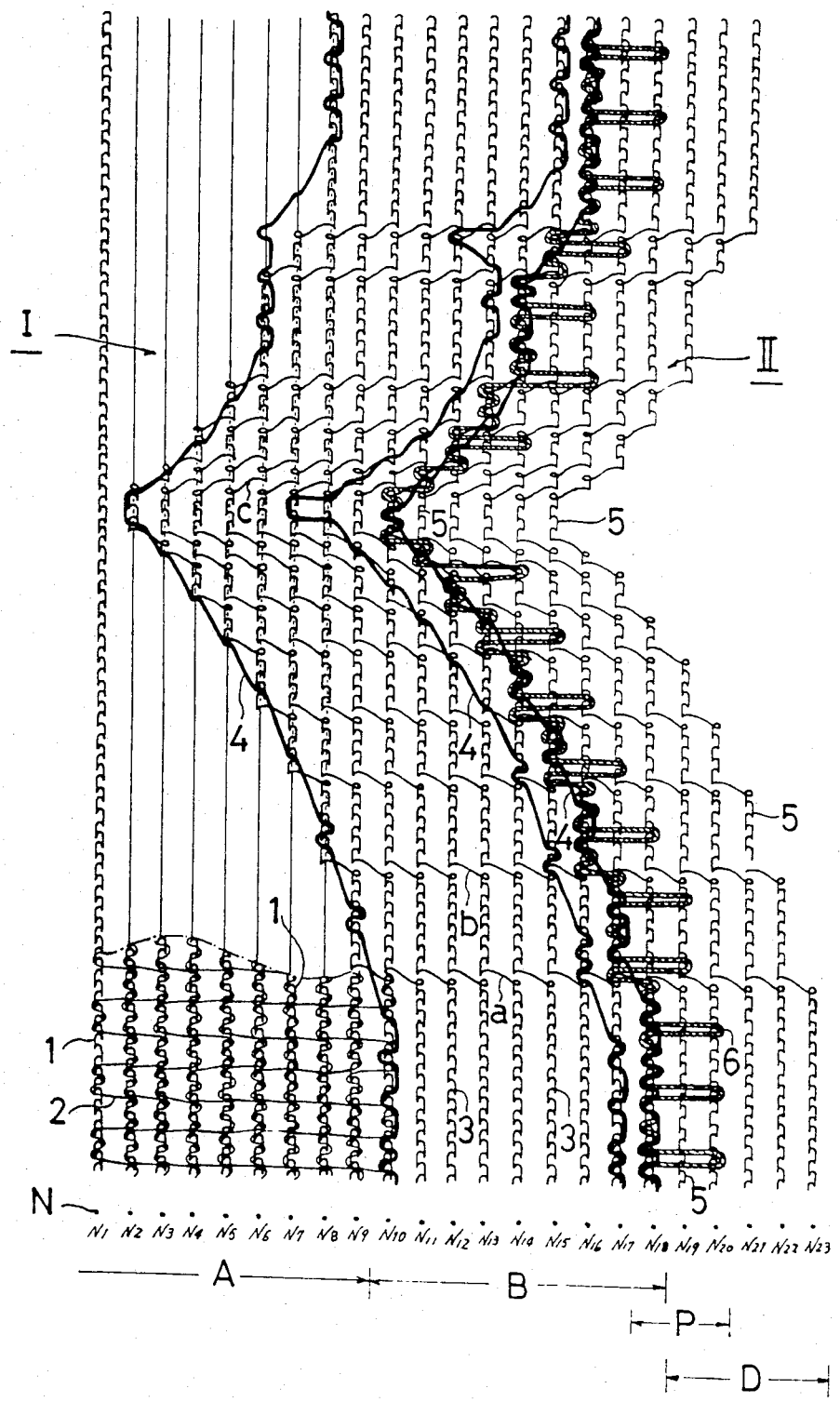
FIG. 4 is a view of an example of a modified knit structure with respect to soluble warps shown in FIG. 2.

FIG. 4 shows a modified knitting mode for the soluble yarn 5 in that the soluble yarns are knit along a sinuate line of the scallops B. When thus knit, the width of the courses D in which the warps are found, namely, soluble fabric II, can be made smaller than those required for knitting the warps 5 in a straight line along the direction of the wale as shown in FIG. 2. For example, as shown in this drawing, threading of five ends of warp yarns 5 respectively on five needles, $N_{19}$–$N_{23}$, may satisfy. In this manner, it is possible to reduce the soluble yarn consumption which leads to a high level of economy.

The foregoing describes an embodiment in which a unit of lace fabric is manufactured. It is also possible to manufacture a plurality of separate units of insoluble lace fabric 10 at one time. The fabric is knit into a piece comprising insoluble fabric portions I and soluble portions II, in which two different portions are arranged alternately with each other. On immersion of the soluble fabric in water, separate lace fabric units are obtained. Thus separation into units without use of a cutter and formation of clear sinuate scallops and picots on the edge of each separate lace fabric are possible.

Figure 6:
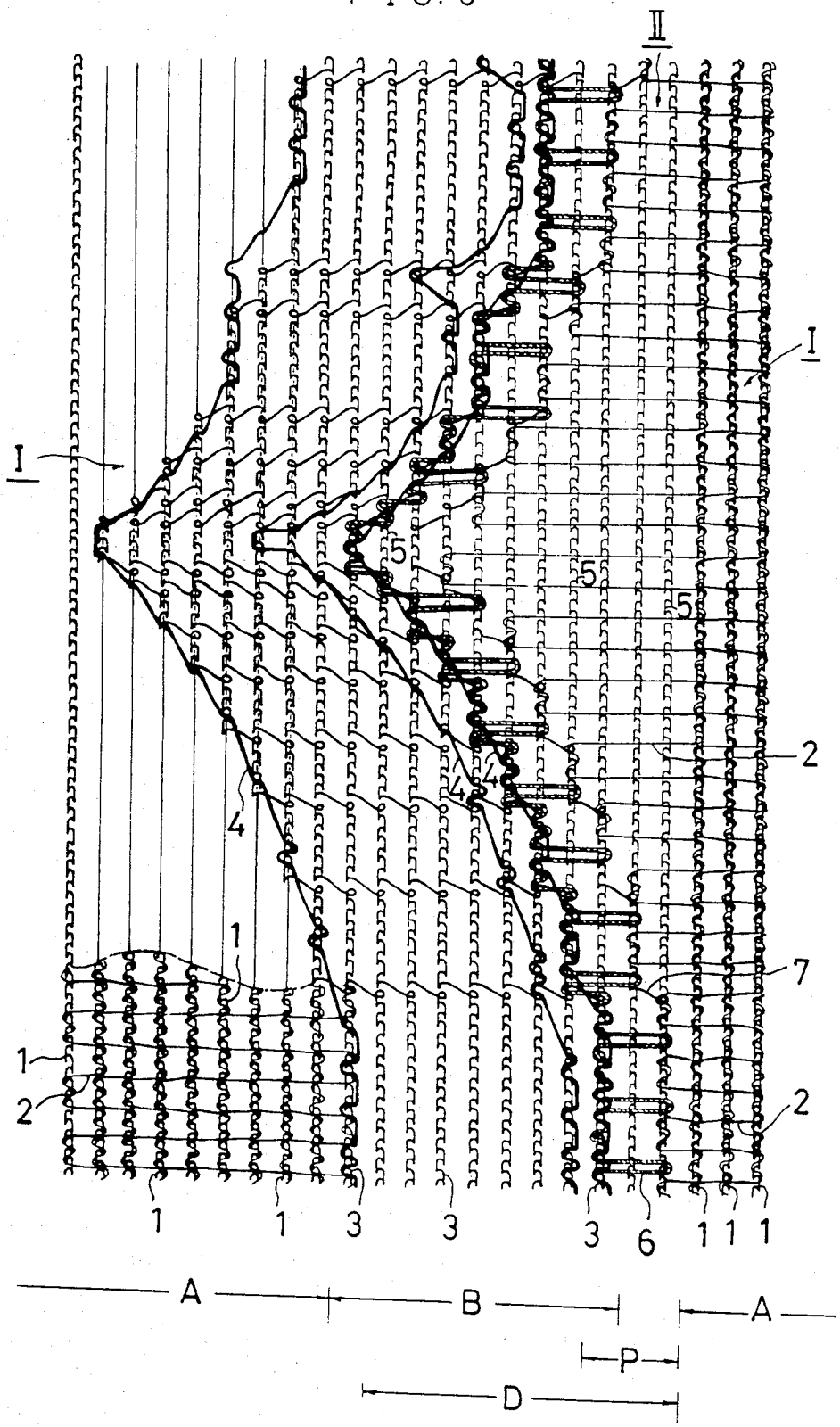
FIG. 6 is a view of a knit structure showing an embodiment wherein a draw thread connects two adjacent insoluble portions of the insoluble fabric portions shown in FIG. 5.
Figure 7:
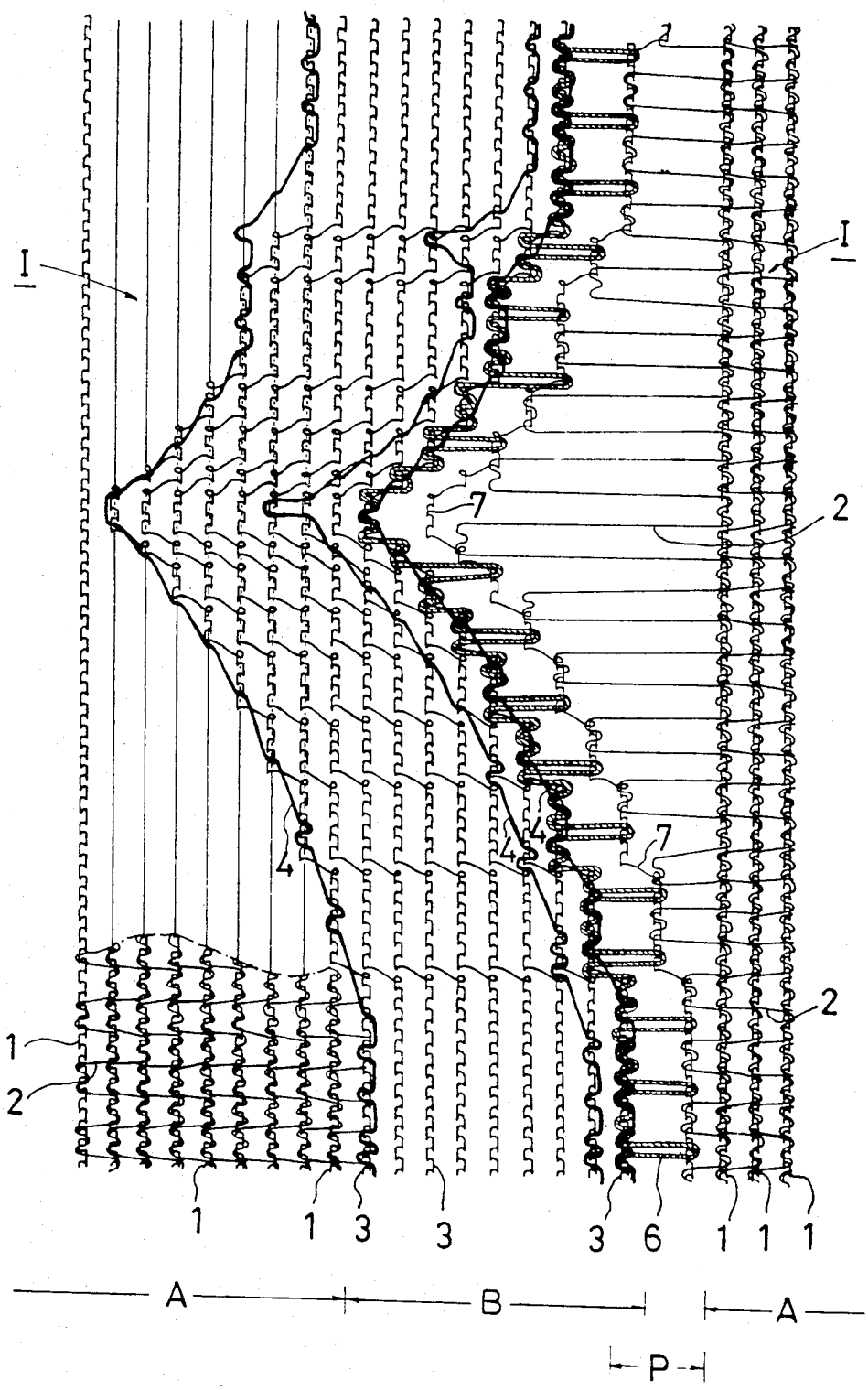
FIG. 7 is a view of the knit structure remaining after the soluble fabric portion shown in FIG. 6 has been dissolved.

FIG. 6 shows a modification of the knit structure shown in FIG. 5. Insoluble fabric portions I and soluble portions II are knit in an alternating arrangement with each other to form a lace fabric containing a plurality of these portions, and adjacent insoluble portions I,I are connected with each other by insoluble draw threads 7. Draw thread 7 is knit in along the sinuate line of the edge portion and connects the tip of the U-shaped protrusions knit from yarn 6 with adjacent insoluble fabric portion I. Though not shown, adjacent insoluble portions I,I may be connected to each other by two draw threads 7, as described above, and the other is knitted-in between draw thread 7 and adjacent insoluble fabric portion I. When the fabric is knit this way, insoluble fabric portions II are removed by immersing the whole of the fabric to dissolve the soluble portion. FIG. 7 illustrates a fabric from which the soluble yarns have been removed by dissolution in water. After removal from the water, the fabric is dried and separated into units of insoluble fabric portions I by removing draw threads 7 from the fabric. In this way, insoluble fabric portions can be made inseparable from each other even after the soluble fabric portions I have been dissolved. This makes the drying step easier and ensures the manufacture of a multitude of lace strips at a more rapid production rate.

Figure 7A:
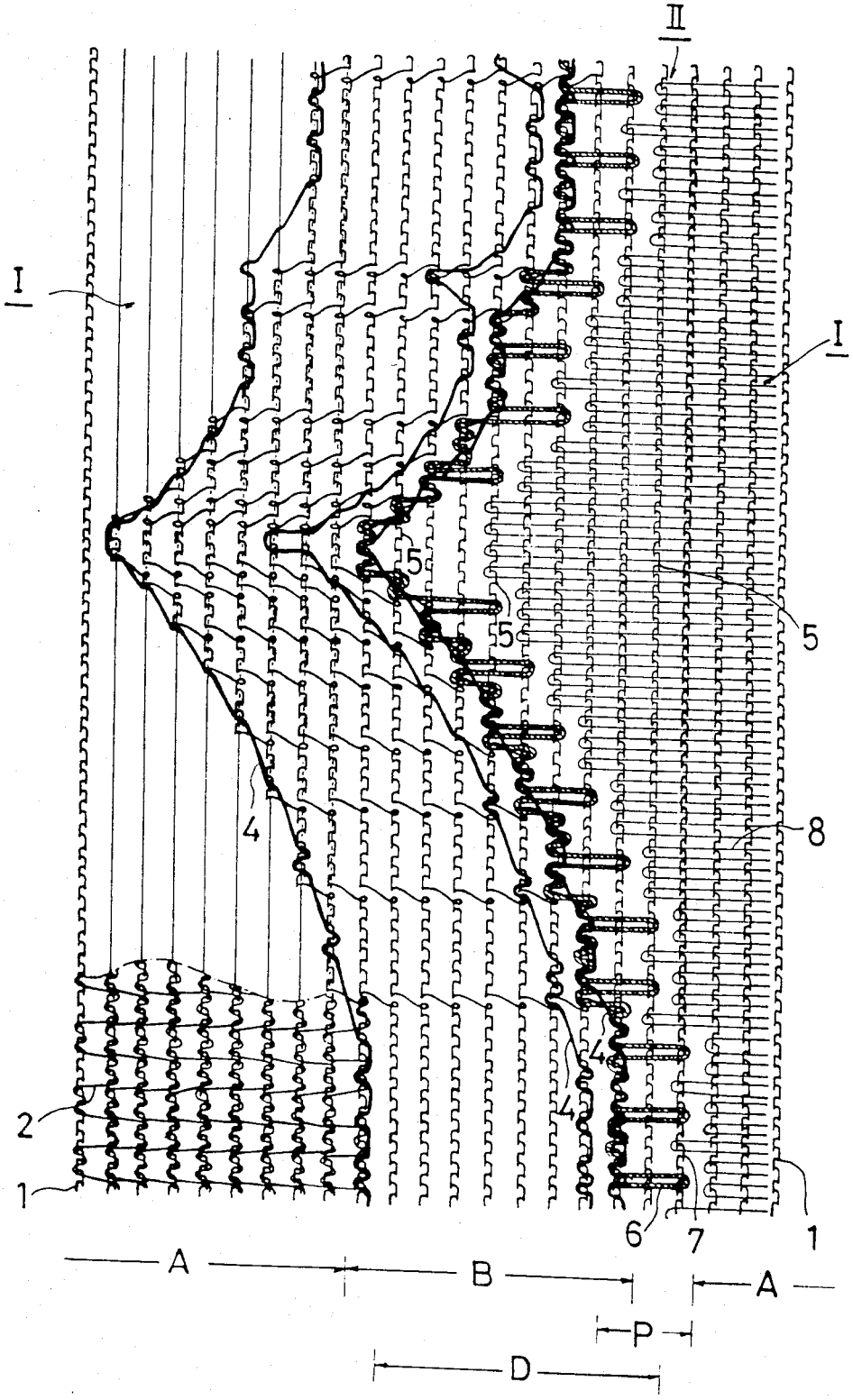
FIG. 7A is another embodiment of the knit lace strip of the invention.

FIG. 7A shows the invention wherein a draw yarn 7 is knitted-in straight in the direction of wale regardless of the sinuation of the scallop portion B and connects the U-bent protrusions of picot-forming yarn 6 at the tip of the scallop portion 13 with adjacent lace texture 10. Reference 8 represents insoluble yarns useful to connect the wales to each other. In this instance, an arrangement of soluble warp yarns 5 over the courses D (corresponding to the area covered by nine needles in the drawing) is satisfactory. After completion of knitting, the fabric can be separated into strips of lace by releasing the draw threads 7 after removal of soluble warp yarns by dissolution, wherein picots P of shorter length than produced in an earlier embodiment appear on the edge of each lace strip.

Figure 7B:
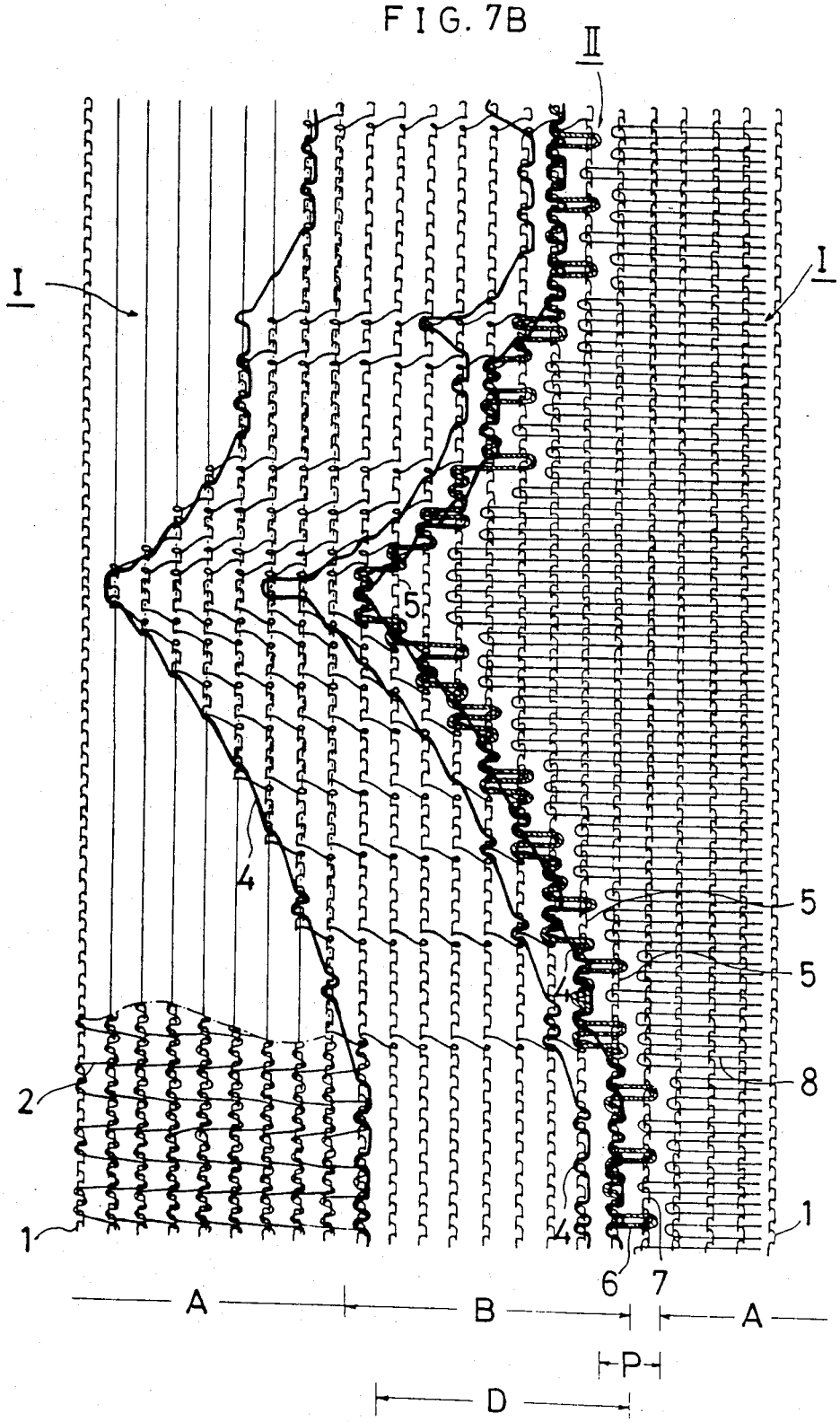
FIG. 7B is still another embodiment of the knit lace strip of the invention.

FIG. 7B shows another embodiment where the length of the protrusions forming the picot-forming yarns 6 is shorter than that of the previous embodiment shown in FIG. 7A. A draw thread 7 is knitted-in straight in the direction of the wale without regard to the sinuation of the scallops B in the same manner as those shown in FIG. 7A. An insoluble yarn 8 is used to connect the wales to each other. In the case of knitting, an arrangement of soluble yarns 5 over the courses D (corresponding to the area covered by eight pieces of needles in the drawings) satisfies the purpose. After completion of the knitting, the fabric can be separated into strips of lace by releasing the draw thread 7 subsequently to dissolution and removal of the soluble warp yarn 5 in the same way as described earlier, where picots P of shorter length than those produced in the earlier embodiment appear on the edge portion of each separated lace strip.

Figure 10:
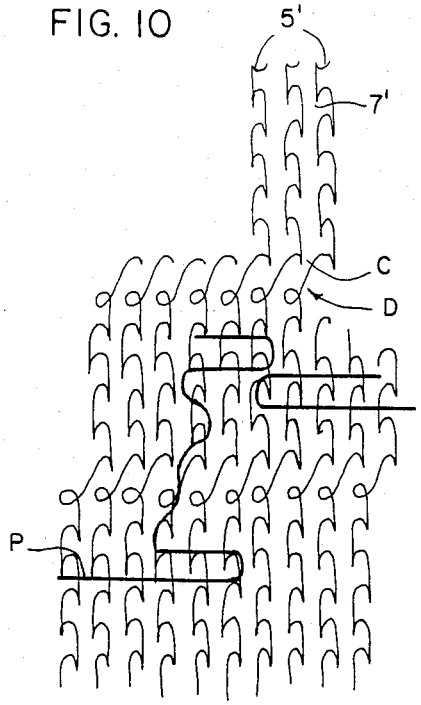
FIG. 10 shows another embodiment of the knit lace strip of the invention.
Figure 11:
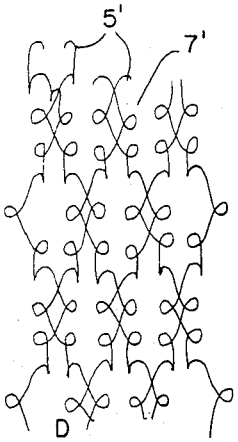
FIG. 11 shows a further embodiment of the knit lace strip of the invention.

In addition to the embodiments shown, the inventive concept extends to other knitted fabric such as elastic or inelastic knits as shown in FIGS. 10 and 11. The different knits of FIGS. 10 and 11 include a draw thread 7' of an insoluble yarn knitted into the sinuate line of the edge portion of the scallops B and connected to the U-shaped protrusions, yarn 6' forming the picots P. On either side of the draw thread 7' is at least one soluble thread 5'. When the fabric is immersed in a solvent for the soluble threads 5', the threads are dissolved leaving the draw thread 7' to keep the fabric intact. By removing the draw thread 7' from the fabric the lace strips are separated into units.

While water soluble yarns have been disclosed, it should be obvious that yarns soluble in other solvents can be used. In manufacture, the completely knit fabric would be immersed in a solvent capable of dissolving the soluble yarn employed.

Figure 12:
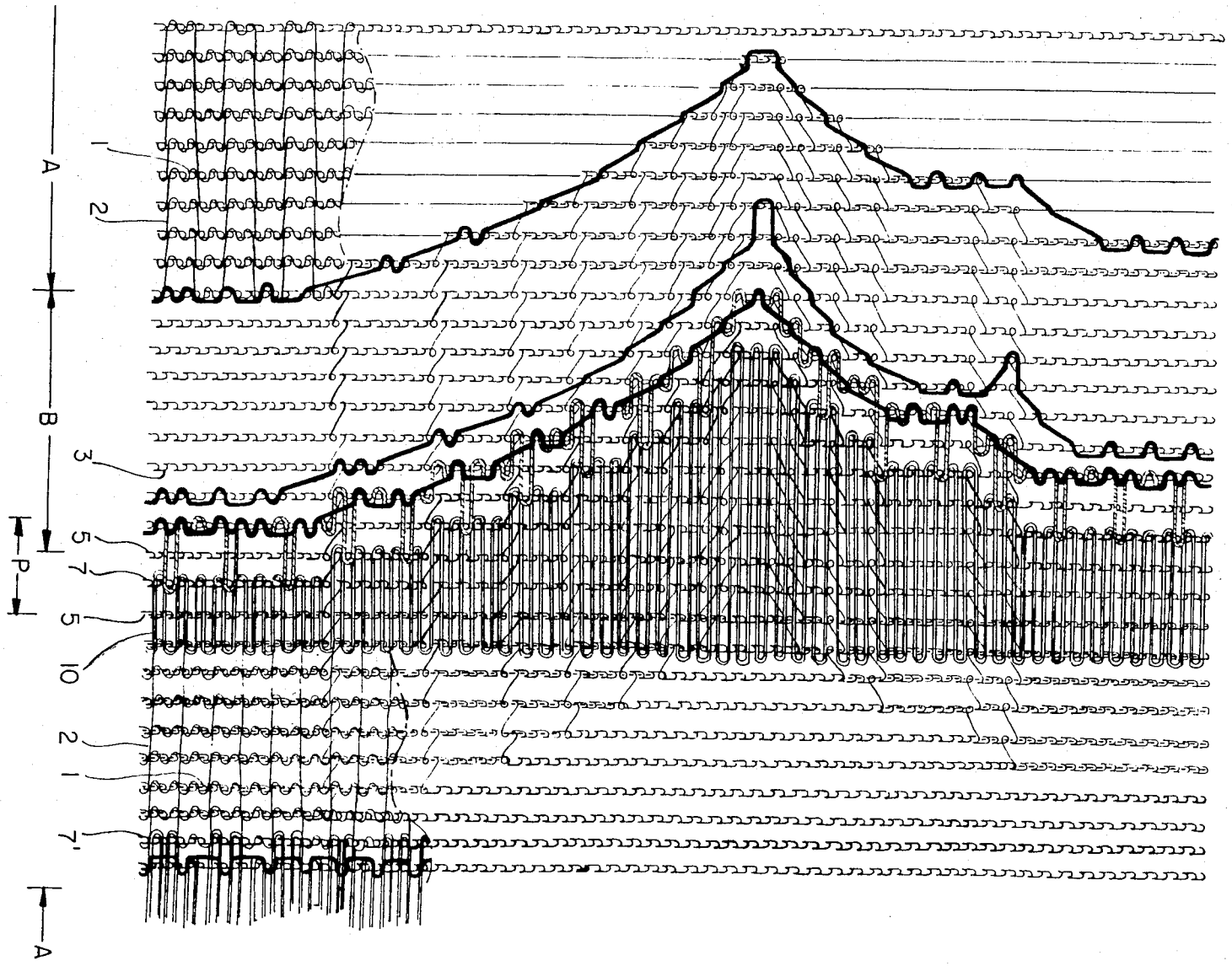
FIG. 12 shows another embodiment of the invention.

In FIG. 12, a draw yarn 7 has soluble yarns 5, 5 on both sides thereof. If the draw thread 7 does not have soluble threads on both sides, then loops of the draw threads will overlap loops of the adjacent non-soluble yanrs when said draw threads moves laterally by one gage, thereby the draw threads being unable to be drawn. The soluble yarns on both sides of the draw thread will facilitate the draw thread to be drawn. In this particular embodiment a portion of the fabric between the two draw threads 7 and 7' will be taken away and will not constitute a part of an end product. A connecting yarn 10 is necessary in this embodiment.

In general a further advantage of providing a draw thread for scallops is that the scallops are well stretched uniformly over the entire length of an edge of a scallops, thereby providing a final product with commercial values.

What we claim is:

1. A warp-knit fabric comprising a plurality of interconnected lace sections of insoluble yarns, each having at least one scallop edge, adjacent sections being interconnected by an insoluble draw thread and at least one soluble yarn adjacent each draw thread, and said sections being separable from one another upon dissolution of said soluble yarns and removal of said draw threads.

2. A warp-knit fabric as in claim 1 wherein said draw threads and said at least one soluble yarns are deployed across more than one wale.

3. A warp-knit fabric as in claim 2 wherein re-entrant picot yarns extend from each of said scallop edges and said draw threads being removably knitted to said picot yarns.

4. A warp-knit fabric as in claim 3 wherein said soluble yarns include at least one pair of soluble yarns straddling each draw thread.

5. A warp-knit fabric as in claim 3 wherein said at least one of said soluble yarns being knitted to said picot yarns.

6. A warp-knit fabric as in claim 4 wherein said at least one soluble yarns of said at least one pair of soluble yarns being knitted to said picot yarns.

7. A warp-knit fabric as in claim 3 or 4 wherein said reentrant picot yarns having base portions being knitted into the edge of said scallops.

8. A warp-knit fabric as in claim 7 wherein said picot yarns being formed of insoluble yarns protruding from said scallops.

9. A warp-knit fabric comprising a plurality of interconnected lace sections of insoluble yarns, each having at least one scallop edge, adjacent sections being interconnected by an insoluble draw thread and at least one soluble yarn adjacent each side of said draw thread, and said sections being separable from one another upon dissolution of said soluble yarns and removal of said draw threads.

* * * * *